US010124608B2

(12) United States Patent
Miyakoshi et al.

(10) Patent No.: US 10,124,608 B2
(45) Date of Patent: Nov. 13, 2018

(54) IMAGE PRINTING APPARATUS

(71) Applicant: CANON KABUSHIKI KAISHA, Tokyo (JP)

(72) Inventors: Arihito Miyakoshi, Tokyo (JP); Masahiko Kubota, Tokyo (JP); Yusuke Imahashi, Kawasaki (JP); Nobuhito Yamaguchi, Inagi (JP); Hiroshi Arimizu, Kawasaki (JP); Yoshinori Itoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/462,692

(22) Filed: Mar. 17, 2017

(65) Prior Publication Data

US 2017/0274676 A1 Sep. 28, 2017

(30) Foreign Application Priority Data

Mar. 28, 2016 (JP) ..... 2016-064713

(51) Int. Cl.
*B41J 29/393* (2006.01)
*B41J 11/00* (2006.01)

(52) U.S. Cl.
CPC ..... *B41J 11/0085* (2013.01)

(58) Field of Classification Search
USPC ..... 347/37, 102, 104
See application file for complete search history.

(56) References Cited

FOREIGN PATENT DOCUMENTS

JP 2007-331255 A 12/2007
JP 2009291982 A * 12/2009

* cited by examiner

*Primary Examiner* — Lam Nguyen
(74) *Attorney, Agent, or Firm* — Canon USA, Inc. I.P. Division

(57) ABSTRACT

A platen disposed at a position at which the platen faces a printing head includes a contact portion that comes into contact with a recording medium, a non-contact portion that does not come into contact with the recording medium, and an ink receiving portion that receives ink ejected to beyond the recording medium. A recessed portion is formed between the ink receiving portion and the contact portion in the width direction of the recording medium so as to be lower than the contact portion in the vertical direction. A supply portion that supplies air to the recessed portion is formed upstream of the recessed portion in the conveyance direction of the recording medium.

16 Claims, 10 Drawing Sheets

IMAGE PRINTING APPARATUS

BACKGROUND OF THE INVENTION

Field of the Invention

The present disclosure generally relates to an ink-jet image printing apparatus including a platen supporting a sheet.

Description of the Related Art

Japanese Patent Laid-Open No. 2007-331255 discloses an ink-jet printing apparatus that forms an image on a recording medium without a margin at the edge of the recording medium, that is, enables so-called "marginless printing". This apparatus uses a suction platen that sucks air from a suction hole to cause the recording medium to adhere to the platen. The suction platen has marginless grooves that receive ink ejected to beyond the recording medium during marginless printing and openings in which ink received in the respective marginless grooves is sucked and collected by a negative pressure.

According to Japanese Patent Laid-Open No. 2007-331255, in some cases, a side edge portion of the recording medium slightly rises from the recording-medium support surface of the platen when the recording medium is supported by suction, and a space is formed between the recording medium and the recording-medium support surface. The space is formed nearer than the openings to the side edge portion of the recording medium, and accordingly, an air flow in the direction from the side edge portion of the recording medium to the space is created toward spaces that are defined by the recording medium and suction grooves and that have a negative pressure. At this time, some of ink mist occurring during marginless printing is caused to flow into the space without being collected in the openings because of the air flow. This can result in some of ink mist adhering to the back surface of the side edge portion of the recording medium.

SUMMARY OF THE INVENTION

The present disclosure provides an image printing apparatus including a printing head that ejects ink to perform printing, a platen that supports a recording medium at a position at which the platen faces the printing head, a conveyance unit that conveys the recording medium in a first direction, a contact portion that is disposed on the platen and comes into contact with the recording medium, a non-contact portion that is disposed on the platen so as to be surrounded by the contact portion and does not come into contact with the recording medium, a first suction hole formed in the non-contact portion for causing the recording medium to adhere to the contact portion, an ink receiving portion that is formed on the platen and receives ink ejected from the printing head to beyond the recording medium in a second direction intersecting the first direction during printing, and a second suction hole that is formed in the ink receiving portion and into which air is sucked near an edge of the recording medium in the second direction in an area through which the recording medium passes. A recessed portion extending in the first direction is formed between the ink receiving portion and the contact portion in the second direction so as to be lower than the contact portion in a vertical direction, and a supply portion that supplies air to a space defined by the recessed portion and the recording medium is formed.

Further features of the present disclosure will become apparent from the following description of exemplary embodiments with reference to the attached drawings.

DESCRIPTION OF THE EMBODIMENTS

An image printing apparatus according to an embodiment of the present disclosure will be described. In the embodiment, components are described by way of example and do not limit the range of the present disclosure. In the following description, a serial type ink-jet printing apparatus is taken as an example. A serial type ink-jet printing apparatus performs printing in a manner in which a head for ejecting ink reciprocates in a direction intersecting the conveyance direction of recording media with respect to the recording media intermittently conveyed in the conveyance direction. However, the present disclosure is not limited to a serial type printing apparatus and can be applied to a line type printing apparatus that uses an elongated head to continuously perform printing. The present disclosure is not limited to an ink-jet printing apparatus and can also be applied to a multifunction printing apparatus having, for example, a copy function and a facsimile function. In the description, a sheet means a sheet-like printing medium such as paper, plastic, or fabric, etc., and an image is formed on the sheet by using the image printing apparatus. The sheet is not limited to a cut sheet and may be a rolled sheet. In the description, the term "cover" means that an object covers another one located below the object such that the other one is invisible and does not include the meaning of blocking an air flow.

First Embodiment

Outline of Apparatus

Figure 1:
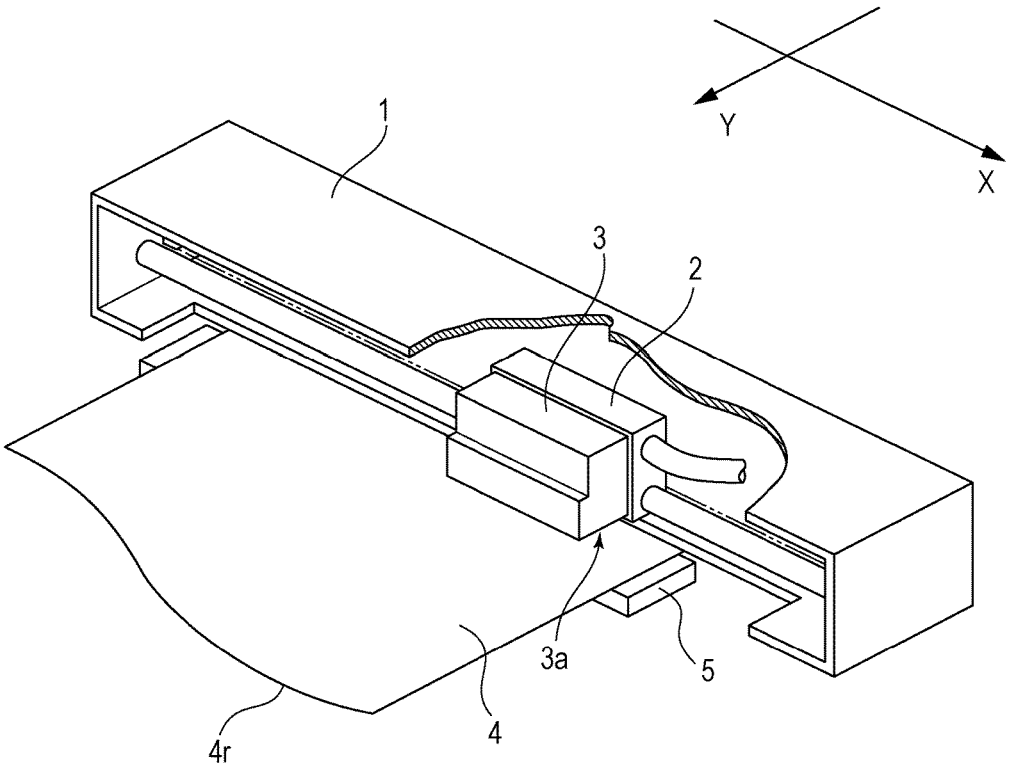
FIG. 1 is a perspective view of an image printing apparatus according to a first embodiment and schematically illustrates its internal structure.

FIG. 1 is a perspective view of an image printing apparatus 1 according to a first embodiment and schematically illustrates its internal structure. In the image printing apparatus 1, a printing head 3 (referred to as a head 3 below) that ejects ink reciprocates in a main scan direction (X-direction in the figure) together with a carriage 2, and droplets of ink (ink droplets) are ejected to a cut sheet 4 (referred to as a sheet 4 below) to print an image. A sheet-conveying mechanism (not illustrated) intermittently conveys the sheets 4 in a direction intersecting the X-direction (Y-direction perpendicular to the X-direction in the embodiment). The image printing apparatus 1 repeats the movement of the head 3 in the X-direction and the intermittent conveyance motion of each sheet 4 in the Y-direction to print an image on a surface (print surface) of the sheet 4. The image printing apparatus 1 includes a platen 5 that supports the sheet 4 conveyed by the sheet-conveying mechanism (not illustrated) from the back surface 4*r* (surface opposite to the print surface) of the sheet 4. The X-direction corresponds to the direction in which the carriage 2 moves and the width direction of the sheet 4 to be conveyed. Accordingly, the X-direction is also referred to as a sheet width direction. The Y-direction is also referred to as a sheet conveyance direction.

As illustrated in FIG. 1, the platen 5 extends in the sheet width direction and is disposed so as to face the ejection-port surface 3*a* of the head 3 on which ejection ports through which ink is ejected are arranged. The platen 5 supports the sheet 4 conveyed by the sheet-conveying mechanism (not illustrated) from the back surface 4*r* of the sheet. The platen 5 includes contact portions 50 in order to maintain an appropriate distance (distance between the sheet and the head) between the ejection-port surface 3*a* and the sheet 4, and the contact portions 50 support the sheet 4 from the back surface 4*r* while inhibiting the rise and bend of the sheet 4 (see FIG. 2).

Structure of Platen

Figure 2:
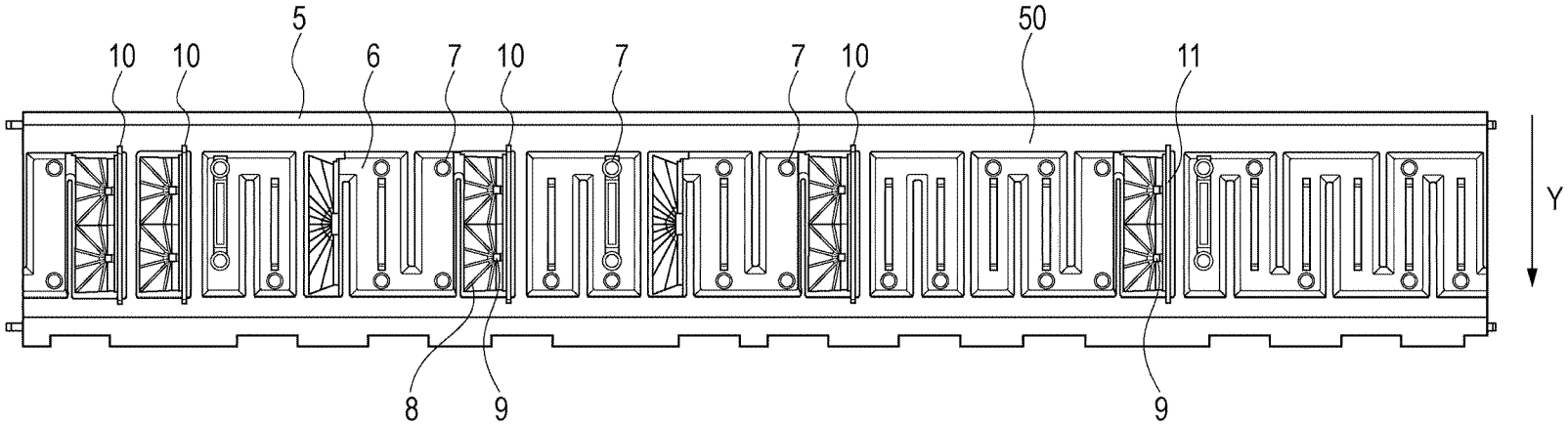
FIG. 2 is a top view of a platen according to the first embodiment.

FIG. 2 is a top view of the platen 5. The platen 5 includes the contact portions 50 that come into contact with the sheet 4 and non-contact portions 6 that do not contact with the sheet 4. The non-contact portions 6 are surrounded by the respective contact portions 50 and lower than the contact portions 50 in the vertical direction. The contact portions 50 support the sheet 4 conveyed to the platen 5 on the back surface 4*r* of the sheet. The platen 5 supports sheets having different widths, and accordingly, the non-contact portions 6 are separated from each other and arranged in the sheet width direction. The non-contact portions 6 each have first suction holes 7. The first suction holes 7 are in communication with a negative-pressure generating member (not illustrated) such as a fan or a pump, which is an air suction source, disposed below the platen 5 in the vertical direction. The platen 5 enables the sheet 4 to adhere to the contact portions 50 in a manner in which air is sucked into the first suction holes 7 downward in the vertical direction and a negative pressure is thereby applied to spaces between the non-contact portions 6 and the sheet 4.

The arrangement of the non-contact portions 6 is determined in accordance with a standard for a printing position. In the embodiment, the standard for a printing position is set to the center of the sheet 4 in the width direction for sheet supply, and this is referred to as a center standard. In the case of sheet supply according to the center standard, the sheets 4 are conveyed such that the center of the width (print width) of the sheets passes through the same position even when the sheets 4 have different widths. In order to enable the sheet supply according to the center standard, different types of the non-contact portions 6 are arranged on the platen 5 so as to be bilaterally symmetric in a state where the central position in the sheet width direction of an area through which each sheet 4 passes is regarded as the standard. The non-contact portions 6 are also arranged so as not to locate within the range of about 2 mm from the edge of sheets having different standard sizes when the sheets are conveyed. The arrangement and shape of the non-contact portions 6 of the platen 5 are determined so as to correspond to the width of the sheets 4 such as L, KG, 2 L, 203 mm×254 mm, Letter, A4, 254 mm×305 mm, A3, enlarging A3, 356 mm×432 mm, A2, enlarging A2, and 17 inches. Instead of the center standard, the non-contact portions 6 may be arranged according to a one-side standard, where the sheets 4 having different widths are lined up on the basis of a left standard position or a right standard position.

The platen 5 also includes ink receiving portions 8 that receive ink ejected from the head 3 to beyond the sheet 4. In the image printing apparatus 1, when printing is performed on the entire sheet 4 without a margin at the edge of the sheet 4, that is, when marginless printing is performed, ink is ejected to beyond the edge of the sheet 4. In the image printing apparatus 1, ink is also ejected to beyond the sheet 4 right before printing, that is, auxiliary ejection is performed to stabilize the ink ejecting performance of the head 3. The ink receiving portions 8 receive ink ejected to beyond the sheet 4. In order to perform marginless printing on the sheets 4 having different widths, the ink receiving portions 8 are arranged in the sheet width direction so as to correspond to the positions of the side edge portions 14 (see FIG. 3A) of each sheet 4.

Figure 3B:
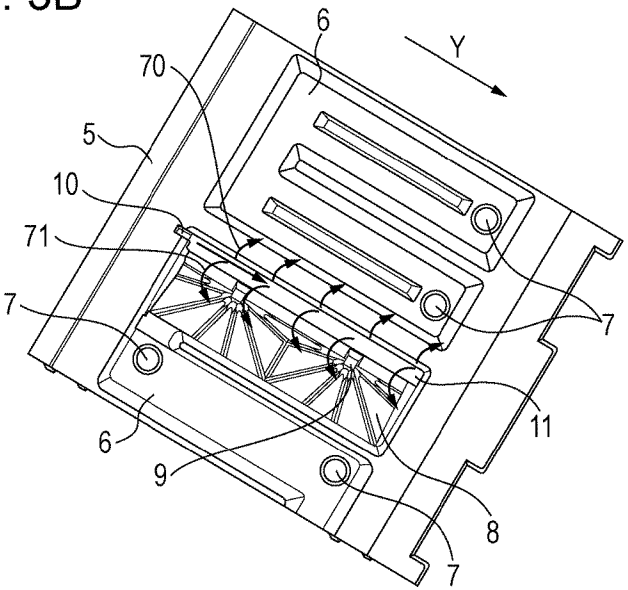
FIGS. 3A to 3D illustrate part of the platen according to the first embodiment.
Figure 3D:
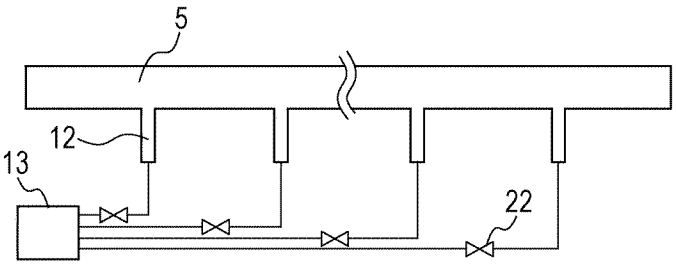
Figure 3A:
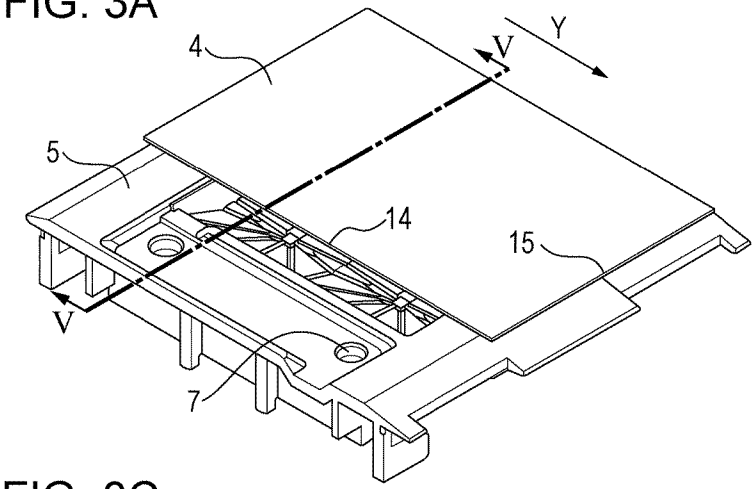

FIGS. 3A to 3D each illustrate part of the platen 5 according to the embodiment. FIG. 3A is a perspective view of part of the platen 5 supporting the sheet 4. In some cases, some of ink ejected to beyond the sheet 4 cannot be received directly in the ink receiving portions 8 and becomes ink mist, which floats in the air. The platen 5 includes second suction holes 9 in the bottom of each ink receiving portion 8 to collect ink mist (see FIG. 3B). The second suction holes 9 are in communication with the negative-pressure generating member (not illustrated), which is operated to suck air downward in the vertical direction. The platen 5 may use a shared negative-pressure generating source to suck air into the first suction holes 7 and the second suction holes 9. The platen 5 collects ink received in the ink receiving portions 8 and ink mist floating in the air in a manner in which air near the side edge portions 14 is sucked into the second suction holes 9. According to the embodiment, one of the second suction holes 9 is formed in each ink receiving portion 8 on the upstream side in the sheet conveyance direction, and the other is formed on the downstream side in the sheet conveyance direction. This inhibits the sheet 4 from rising at its leading end portion 15 and trailing end portion (not illustrated) when an image is being printed on the sheet 4. The number of the second suction holes 9 formed in each ink receiving portion 8 is not limited thereto and may be one or more. The second suction holes 9 are preferably formed on the upstream and downstream sides as described in the embodiment.

In each ink receiving portion 8, a sloped surface 81 lowering from the outside to the inside in the sheet width direction is formed. Accordingly, the inner portion of the ink receiving portion 8 in the sheet width direction is lower (in the vertical direction) than an outer portion of the ink receiving portion 8 in the sheet width direction. The second suction holes 9 are formed in the lower portion of the sloped surface 81 in the vertical direction (that is, the inner portion in the sheet width direction). The ink receiving portions 8 are arranged near the side edge portions 14 of the sheet 4 so as to correspond to different widths of the sheet when the platen 5 supports the sheet 4. When the sheet 4 passes through each ink receiving portion 8 while being conveyed, the second suction holes 9 are located within the area through which the sheet 4 passes, and part (outer portion in the sheet width direction) of the ink receiving portion 8 is located beyond the area through which the sheet 4 passes and receives ink ejected to beyond the sheet 4. Accordingly, during marginless printing, ink ejected to beyond the side edge portions 14 of the sheet 4 is received by the sloped surface 81 of the ink receiving portion 8 and collected from the sloped surface 81 into the second suction holes 9.

FIG. 3B is a top view of part of the platen 5 supporting the sheet 4. The platen 5 includes recessed portions 11 extending in the sheet conveyance direction between the corresponding ink receiving portions 8 and contact portions 50. The recessed portions 11 are formed so as to be lower than the contact portions 50 in the vertical direction and do not come into contact with the sheet 4. The recessed portions 11 are formed so as to be higher than the sloped surface 81 of each ink receiving portion 8 in the vertical direction. The platen 5 also includes supply portions 10 that are disposed upstream of the corresponding recessed portions 11 in the sheet conveyance direction and that supply air to the recessed portions 11. Each recessed portion 11 and the corresponding supply portion 10 are disposed on the inner side of the corresponding ink receiving portion 8 in the sheet width direction in the area through which the sheet 4 passes. Accordingly, each recessed portion 11 and the corresponding supply portion 10 are located near the second suction holes 9 of the corresponding ink receiving portion 8.

According to the embodiment, the supply portions 10 serve as outlets from which air blows upward in the vertical direction. When the sheet 4 is conveyed and adheres to the contact portions 50, the sheet 4 covers the recessed portions 11 and the supply portions 10, and spaces are created between the sheet 4 and the recessed portions 11 and between the sheet 4 and the supply portions 10. The air blows upward in the vertical direction from each supply portion 10 against the sheet 4 and flows toward the space defined by the sheet 4 and the corresponding recessed portion 11 from the upstream side to the downstream side in the sheet conveyance direction. Each recessed portion 11 and the corresponding supply portion 10 are in communication with each other such that the air blowing from the supply portion 10 flows through the recessed portion 11 when the contact portions 50 support the sheet 4.

Figure 3C:
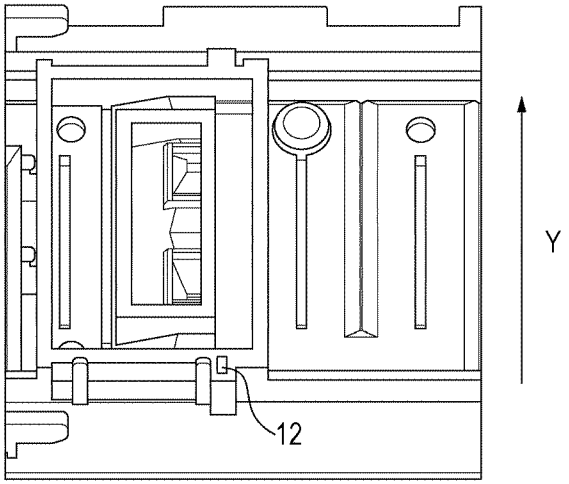

FIG. 3C illustrates part of the platen 5 when the platen 5 is viewed from its back surface (surface opposite to a surface on which the sheet 4 is supported. According to the embodiment, air introduction portions 12 through which air is supplied to the corresponding supply portions 10 are formed in the platen 5. Each supply portion 10 disposed on the platen 5 on a sheet support surface side is in communication with an air-supplying unit 13 (see FIG. 3D) with the corresponding air introduction portion 12 interposed therebetween. The air-supplying unit 13 is disposed below the platen 5 in the vertical direction and supplies air to the air introduction portions 12 by using a fan or a pump, and the air blows from the corresponding supply portions 10.

According to the embodiment, as illustrated in FIG. 3D, valves 22 (switching units) are disposed between the air-supplying unit 13 and the corresponding air introduction portions 12. When the sheet 4 is caused to adhere to the contact portions 50, opening and closing of the valves 22 is controlled such that air does not blow from the supply portions 10 that are not located immediately below the side edge portions 14 of the sheet 4. Specifically, the valves 22 that open (in a connection state) are located between the air-supplying unit 13 and the air introduction portions 12 in communication with the supply portions 10 immediately below the side edge portions 14, and the other valves 22 close (in a non-connection state). That is, control is performed such that air does not blow from the supply portions 10 that are located on the central side in the sheet width direction that is away from the side edge portions 14 of the sheet 4 when the sheet 4 is conveyed. More specifically, when the A3 size sheet 4 is conveyed, control is performed such that air does not blow from the supply portions 10 that are located at positions corresponding to the side edge portions of the A4 size sheet. In addition, air does not blow from the supply portions 10 that are located beyond the side edge portions 14 of the sheet 4 in the sheet width direction when the sheet 4 is conveyed. Specifically, when the A3 size sheet 4 is conveyed, air does not blow from the supply portions 10 that are located at positions corresponding to the side edge portions of the A2 size sheet.

The upper limit of the amount of air to be supplied through each supply portion 10 is three times the amount of air to be sucked into the corresponding second suction holes 9. The reason is that in the case where the amount of air to be supplied is too larger than the amount of air to be sucked, the sheet 4 cannot adhere to the contact portions 50 and rises in the vertical direction.

Technical effects that are achieved by the supply portions 10 and the recessed portions 11 that are formed in the ink receiving portions 8 will now be described in detail with reference to a comparative example.

Figure 4:
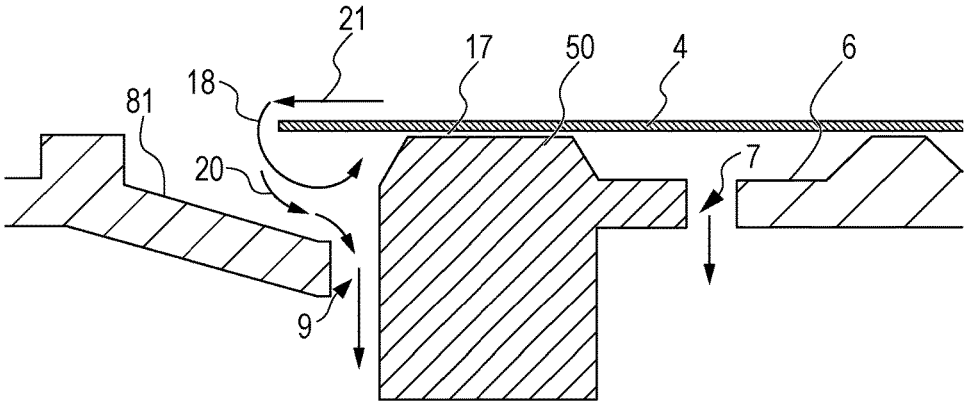
FIG. 4 is a sectional view of part of a platen in a comparative example to the first embodiment and illustrates air flows.
Figure 5:
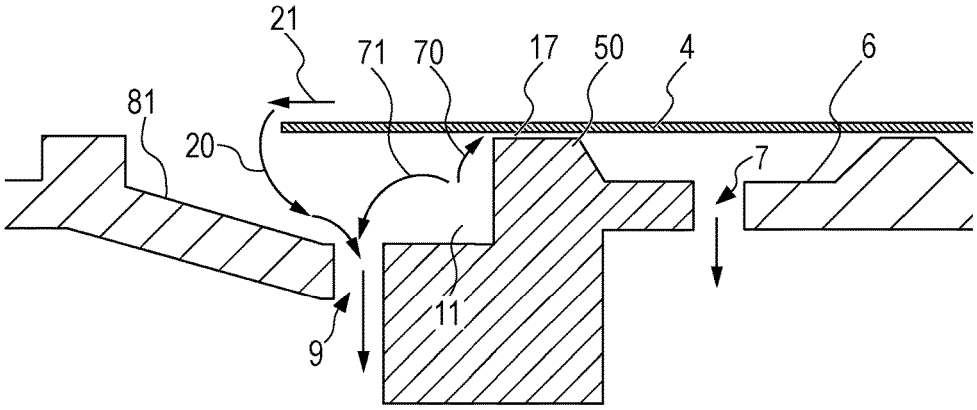
FIG. 5 is a sectional view of part of the platen according to the first embodiment and illustrates air flows.

FIG. 5 is a sectional view of part of the platen 5 taken along line V-V in FIG. 3A and illustrates air flows by arrows when air is sucked into the first suction holes 7 and the second suction holes 9. FIG. 4 illustrates a comparative example in which no recessed portion 11 is formed between the ink receiving portion 8 and the contact portion 50. As illustrated in FIG. 4, when air is sucked into the first suction holes 7 in the comparative example, the space defined by the sheet 4 and the non-contact portion 6 has a negative pressure. Continuous suction of air creates air flows (air flow 21 and air flow 18), that is, air near the edge or print surface of the sheet 4 flows into the space having a negative pressure via a small space 17 between the back surface 4*r* of the sheet and the contact portion 50. In some cases, some of ink ejected to beyond the sheet 4 becomes ink mist, which floats in the air, over the edge of the sheet 4. For this reason, the second suction holes 9 are formed to suck air. This enables ink mist to be sucked and inhibits ink mist from adhering to the back surface 4*r* of the sheet. At this time, most of ink mist is sucked into the second suction holes 9 (air flow 20), but some of ink mist flows together with the air flow 18 along the back surface 4*r* of the sheet (space 17) and flows into the space that is defined by the sheet 4 and the non-contact portion 6 and that has a negative pressure. This occurs because the space 17 is closer than the second suction holes 9 to the edge of the sheet 4. Accordingly, in some cases, the second suction holes 9 cannot inhibit ink mist from adhering to the back surface 4*r* of the sheet, and the back surface of the sheet 4 is stained.

FIG. 5 is a diagram illustrating the embodiment and illustrates air flows by arrows in the case where the supply portion 10 is formed between the ink receiving portion 8 and the contact portion 50, air is sucked into the first suction holes 7 and the second suction holes 9, and air is supplied through the supply portion 10. When air is sucked into the first suction holes 7 in the same manner as the comparative example, the space defined by the sheet 4 and the non-contact portion 6 has a negative pressure. At this time, when air is supplied through the supply portion 10, the air supplied upward in the vertical direction comes in contact with the back surface 4*r* of the sheet and flows through the recessed portion 11 from the upstream side to the downstream side in the sheet conveyance direction. The air flowing through the recessed portion 11 is separated into an air flow 70 passing through the space 17 toward the space having a negative pressure created by the air sucked into the first suction holes 7 and an air flow 71 toward the second suction holes 9, into which air is sucked. Accordingly, almost all of the air (air flow 21) containing ink mist near the edge of the sheet 4, together with the air flow 20, is easily collected into the second suction holes 9. Supplying air through the supply portion 10 in the above manner enables ink mist to be efficiently collected into the second suction holes 9. Accordingly, the flow of ink mist along the back surface 4*r* of the sheet toward the space 17 is suppressed, and the back surface of the sheet 4 is inhibited from being stained.

In addition, forming the supply portion 10 enables air to be supplied to the second suction holes 9 from the supply portion 10 and the recessed portion 11 (air flow 71). Accordingly, the air flow 20 from the edge of the sheet 4 toward the second suction holes 9 is reduced. This reduces the air flow 21 created at the edge or on the print surface of the sheet 4. Accordingly, during marginless printing, ink ejected from the head 3 is inhibited from being blown away by the air flow 21 and inhibited from being out of place at the edge of the sheet 4. Consequently, an ink flow at the edge of the sheet 4 is reduced, and the quality of an image at the edge of the sheet 4 can be improved.

Air supply through the supply portions 10 is controlled in accordance with the size of the sheet 4 to be conveyed. The air is supplied through the supply portions 10 located immediately below the side edge portions 14 of the sheet 4, and air supply through the other supply portions 10 is stopped in a manner in which the corresponding valves 22 (see FIG. 3D) are closed. Thus, air is not supplied in the area through which the sheet 4 passes, and the sheet 4 does not rise. The control is performed in a manner in which a signal of the size of the sheet that is specified by a user for the image printing apparatus 1 is received.

When the platen 5 is viewed from above while the contact portions 50 are supporting the sheet 4, the second suction holes 9 and the supply portions 10 are located within the area through which the sheet 4 passes and covered by the sheet 4. The reason is that the supply portions 10 need to be adjacent to the corresponding contact portions 50 in order to supply air through the supply portions 10 to the spaces between the sheet 4 and the non-contact portions 6 that have a negative pressure created by the air sucked into the first suction holes 7. In the case where at least one of the second suction holes 9 is located beyond the edge of the sheet 4 in the sheet conveyance direction, air on the edge side of the sheet 4 is sucked from beyond the sheet 4, and accordingly, the air flow 21 along the print surface of the sheet 4 increases. Consequently, ink at the edge of the sheet is likely to be out of place during marginless printing, and the quality of an image decreases. In the case where at least one of the second suction holes 9 is located immediately below the edge of the sheet 4, it is thought that ink ejected to beyond the sheet 4 may fall, adhere to the second suction hole 9, and close the second suction hole 9. According to the embodiment, these problems are solved in a manner in which all of the second suction holes 9 are formed at positions at which the second suction holes 9 are covered by the sheet 4 when the contact portions 50 support the sheet 4.

Figure 10:
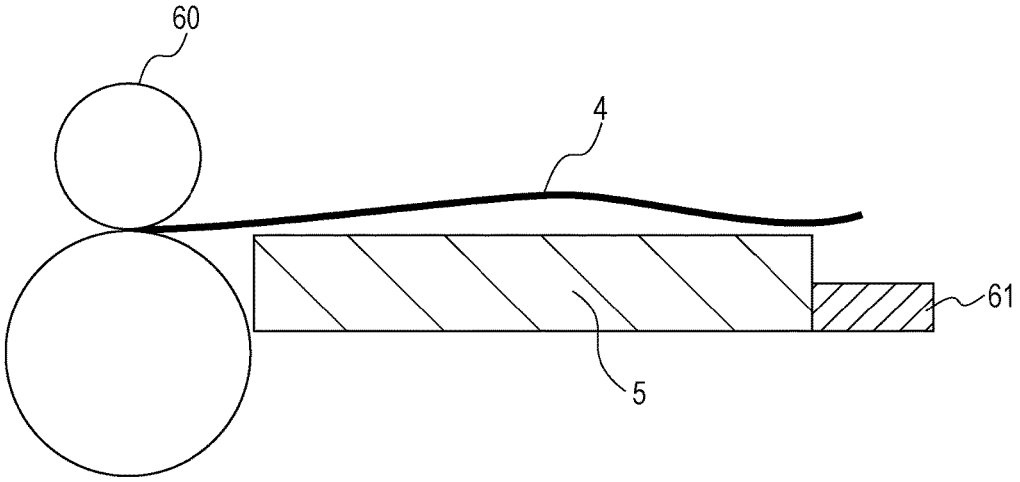
FIG. 10 is a cross-sectional diagram illustrating conveyance of a recording medium.

According to the embodiment, the supply portions 10 are disposed upstream of the corresponding recessed portions 11 in the sheet conveyance direction. As illustrated in FIG. 10, a pair of conveyance rollers 60 is disposed upstream of the platen 5 in the sheet conveyance direction, and a discharge tray 61 is disposed downstream of the platen 5 in the sheet conveyance direction. The sheet 4 is held by the conveyance rollers 60 while being interposed therebetween upstream of the platen 5 in the sheet conveyance direction, and accordingly, the sheet 4 is unlikely to rise even when air is supplied from the supply portions 10 toward the back surface 4*r* of the sheet. Although sheet-discharging rollers (not illustrated) are disposed downstream of the platen 5 in the sheet conveyance direction, a force by which the sheet 4 is held by the sheet-discharging rollers is weaker than by the conveyance rollers 60. Accordingly, in the case where the supply portions 10 are disposed only on the downstream side in the sheet conveyance direction, the sheet 4 is likely to rise when air is supplied toward the back surface 4*r* of the sheet. For this reason, according to the embodiment, the supply portions 10 are preferably disposed upstream of the corresponding recessed portions 11 in the sheet conveyance direction.

The recessed portions 11 are formed so as to be as high as the lowest portion of the sloped surface 81 in the vertical direction or so as to be higher than the lowest portion of the sloped surface 81 in the vertical direction. Thus, the air flowing through each recessed portion 11 is easily supplied to the corresponding space 17. Supposing that each recessed portion 11 is formed so as to be lower than the lowest portion of the sloped surface 81 in the vertical direction, a large amount of the air flowing through the recessed portion 11 is sucked into the corresponding second suction holes 9, and air supplied to the space 17 reduces. That is, the air flow 71 increases, and the air flow 70 reduces. In the embodiment, air is easily supplied from each recessed portion 11 to the corresponding space 17, and the back surface of the sheet 4 can thereby be inhibited from being stained.

The second suction holes 9 share the negative-pressure generating member (not illustrated) with the first suction holes 7. Accordingly, the number of components such as a duct can be reduced to reduce the cost, and space-saving can be achieved. The air-supplying unit 13 supplies air outside the image printing apparatus 1 to the supply portions 10, and accordingly, the air containing no ink mist can be supplied through the supply portions 10.

Figure 6A:
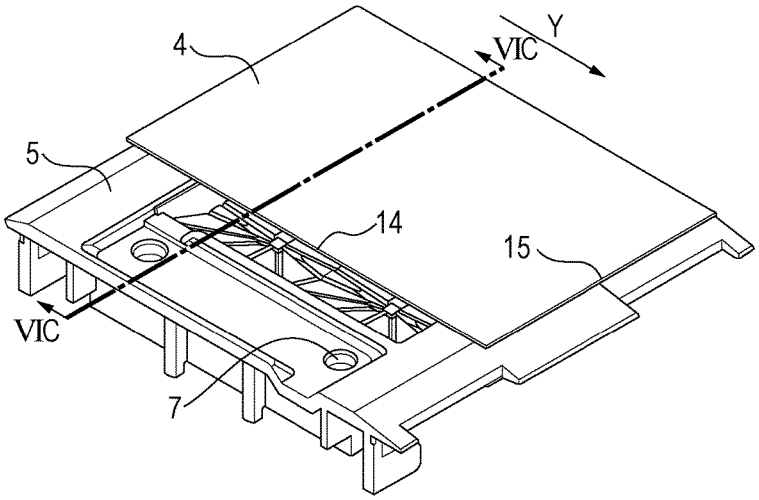
FIGS. 6A to 6C illustrate part of a platen according to a modification to the first embodiment.
Figure 6B:
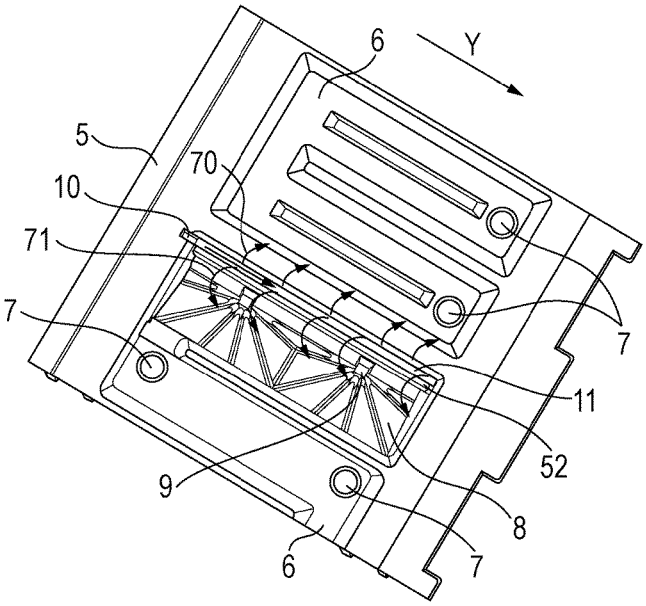
Figure 6C:
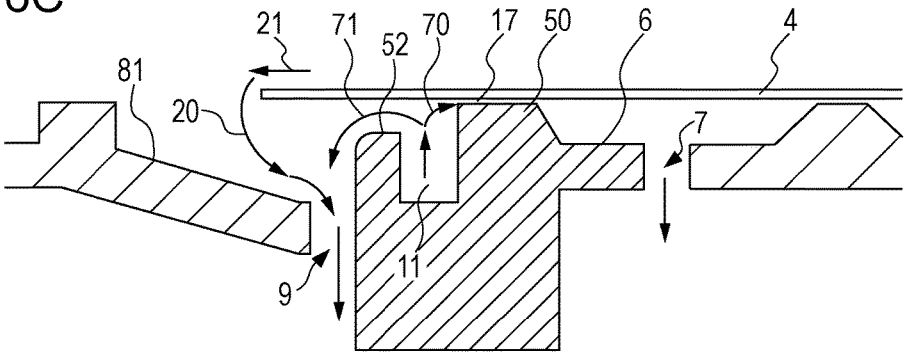

A modification to the embodiment will now be described with reference to FIGS. 6A to 6C. FIG. 6A is a perspective view of part of the platen 5 supporting the sheet 4. FIG. 6B is a top view of part of the platen 5 supporting the sheet 4. FIG. 6C is a sectional view of part of the platen 5 taken along line VIC-VIC in FIG. 6A and illustrates air flows by arrows when air is sucked into the first suction holes 7 and the second suction holes 9. In this modification, each recessed portion 11 includes a wall 52 that is disposed beyond the corresponding supply portion 10 in the sheet width direction and that extends in the sheet conveyance direction. The wall 52 is located on the inner side of the corresponding ink receiving portion 8 in the sheet width direction. The wall 52 is higher than the recessed portion 11 in the vertical direction and lower than the contact portions 50. Accordingly, the wall 52 does not come into contact with the sheet 4. The wall 52 reduces air supplied from the supply portion 10 to the second suction holes 9 through the recessed portion 11 because the wall 52 acts as a barrier. Accordingly, a large amount of the air flowing through the recessed portion 11 is supplied to the space 17, air can be more efficiently supplied from the supply portion 10 to the space 17, and the back surface of the sheet 4 can be inhibited from being stained.

Second Embodiment

Figure 7A:
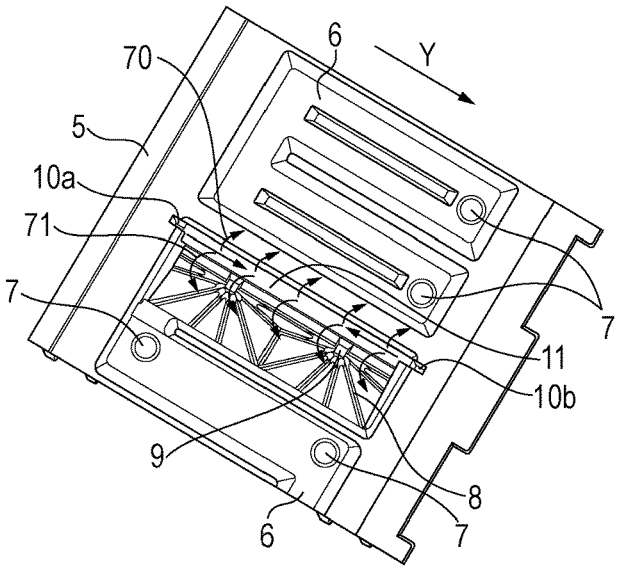
FIGS. 7A to 7C illustrate part of a platen according to a second embodiment.
Figure 7B:
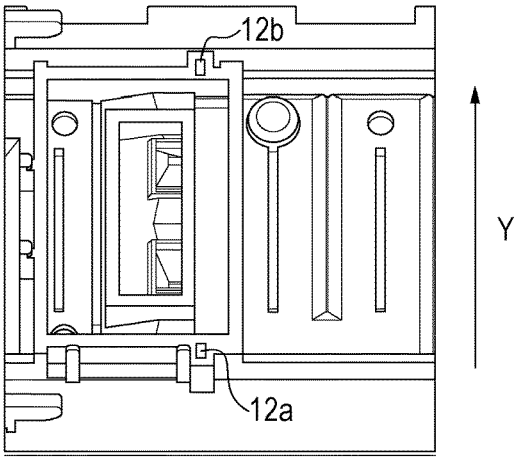
Figure 7C:
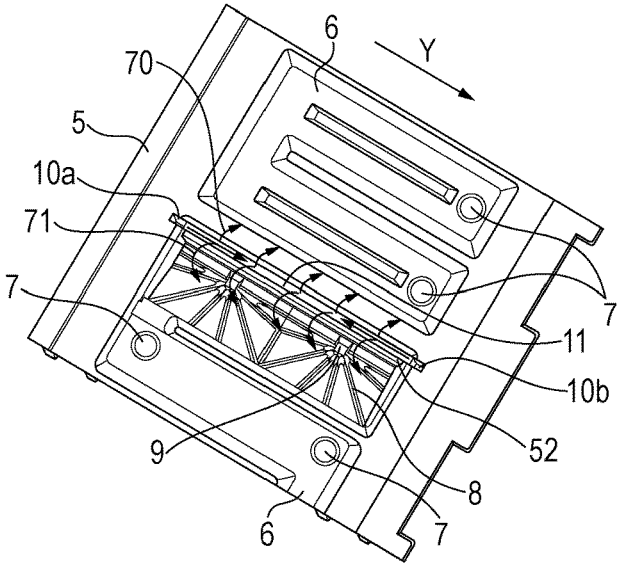

FIGS. 7A to 7C illustrate part of a platen 5 according to a second embodiment. FIG. 7A is a top view thereof. FIG.

7B is a bottom view of part of the platen 5 on its back-surface side (surface opposite to a support surface on which the sheet 4 is supported). FIG. 7C is a top view of a modification to the second embodiment. The basic structure of the apparatus is the same as in the first embodiment, and components having the same function are designated by like symbols.

According to the second embodiment, as illustrated in FIG. 7A, a supply portion 10*a* is disposed upstream of each recessed portion 11 in the sheet conveyance direction, and a supply portion 10*b* is disposed downstream of each recessed portion 11 in the sheet conveyance direction. Accordingly, air is supplied from both sides upstream and downstream of the recessed portion 11 in the sheet conveyance direction toward the recessed portion 11. In addition, as illustrated in FIG. 7B, air introduction portions 12*a* corresponding to the respective supply portions 10*a* and air introduction portions 12*b* corresponding to the respective supply portions 10*b* are disposed on the back surface of the platen 5.

The air introduction portions 12 (the air introduction portions 12*a* and 12*b* are referred to as the air introduction portions 12) are in communication with the air-supplying unit 13 (see FIG. 3D) disposed below the platen 5 in the vertical direction, and air is supplied to the supply portions 10 (the supply portions 10*a* and 10*b* are referred to as the supply portions 10) through the air introduction portions 12. The valves 22 are disposed between the air-supplying unit 13 and the corresponding air introduction portions 12 as in the first embodiment. When the sheet 4 is caused to adhere to the contact portions 50, opening and closing of the valves 22 is controlled such that air does not blow from the supply portions 10 that are not located immediately below the side edge portions 14 of the sheet 4. Specifically, the valves 22 that open are located between the air-supplying unit 13 and the air introduction portions 12 in communication with the supply portions 10 immediately below the side edge portions 14, and the other valves 22 close.

In the case where air is supplied from both sides upstream and downstream of each recessed portion 11 in the sheet conveyance direction, the air is likely to diffuse across the entire recessed portion 11. Accordingly, air is supplied to the entire space 17 more easily than in the first embodiment, and the back surface 4*r* of the sheet can be inhibited from being stained. This reduces the air flow 21 along the print surface of the sheet 4, and ink can be inhibited from being out of place at the edge of the sheet 4. According to the modification to the second embodiment, as illustrated in FIG. 7C, the wall 52 may be disposed beyond each recessed portion 11 in the sheet width direction.

Third Embodiment

Figure 8A:
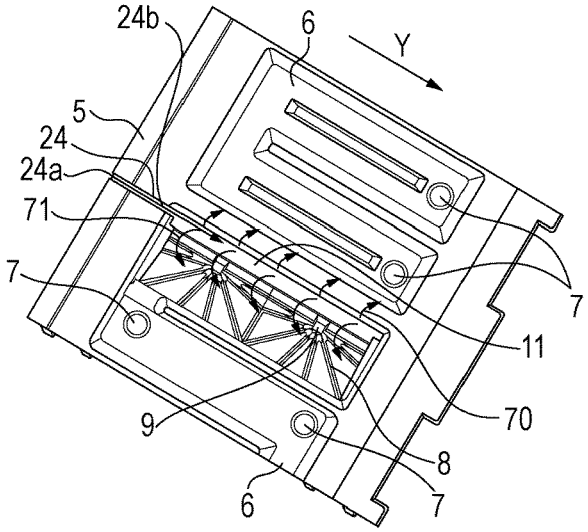
FIGS. 8A to 8C illustrate part of a platen according to a third embodiment.
Figure 8B:
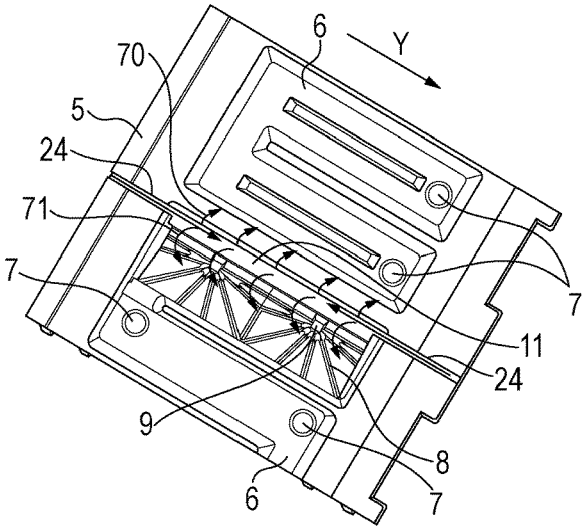
Figure 8C:
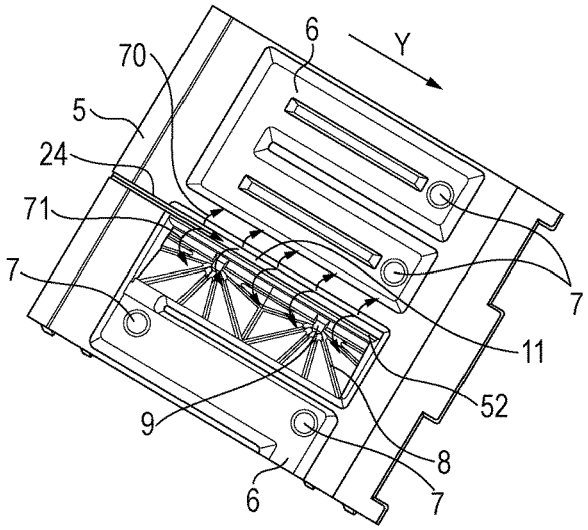

FIGS. 8A to 8C illustrate part of a platen 5 according to a third embodiment. FIG. 8A is a top view thereof. FIG. 8B is a top view of a first modification to the third embodiment. FIG. 8C is a top view of a second modification to the third embodiment. The basic structure of the apparatus is the same as in the first embodiment, and components having the same function are designated by like symbols.

According to the third embodiment, as illustrated in FIG. 8A, grooves 24 are formed so as to extend from the corresponding recessed portions 11 to the upstream side in the sheet conveyance direction. An end (end portion 24*a*) of each groove 24 is located at the edge of the platen 5 on the upstream side in the sheet conveyance direction and is in communication with the outside of the platen 5. The other end (end portion 24*b*) of each groove 24 on the downstream side in the sheet conveyance direction is in communication with the corresponding recessed portion 11. The groove 24 is formed at the same position as the recessed portion 11 in the sheet width direction and accordingly located within the area through which the sheet 4 passes when the sheet 4 is conveyed.

According to the first embodiment and the second embodiment, air is supplied from the air-supplying unit 13 to the recessed portions 11 through the corresponding supply portions 10. According to the third embodiment, air is taken in from the grooves 24 extending from the corresponding recessed portions 11 to the upstream side in the sheet conveyance direction and supplied to the recessed portions 11. When air is sucked into the first suction holes 7 and the second suction holes 9, the area through which the sheet 4 passes has a negative pressure lower than the pressure of the surrounding. The recessed portions 11 also have a negative pressure, and the pressure at the end portion 24*b* decreases. When the difference in the pressure is thus made between the end portion 24*a*, at which the pressure is the atmospheric pressure, and the end portion 24*b*, at which the pressure is a negative pressure, air is supplied from the end portion 24*a* toward the end portion 24*b*. The air supplied to the end portion 24*b* flows through the recessed portion 11 in communication with the end portion 24*b* from the upstream side to the downstream side in the sheet conveyance direction. That is, the grooves 24 serve as supply portions that supply air to the recessed portions 11. The air thus supplied from the grooves 24 to the recessed portions 11 is separated into the air flow 70 and the air flow 71 due to the air sucked into the first suction holes 7 and the second suction holes 9. Since the grooves 24 are formed within the area through which the sheet 4 passes, ink mist floating near the side edge portions 14 of the sheet 4 is hardly taken in the grooves 24.

According to the third embodiment, the air-supplying unit is not used to supply air to the recessed portions 11, and accordingly, the size and power consumption of the apparatus can be reduced. Air is supplied to the spaces that are defined by the recessed portions 11 and the sheet 4 and that have a negative pressure created by the air sucked into the first suction holes 7 and the second suction holes 9. At this time, the air is supplied such that the negative pressure is relieved and the spaces have the atmospheric pressure. Accordingly, there is little possibility that the sheet 4 rises due to excessive air supply to the recessed portions 11.

According to the third embodiment, the grooves 24, which serve air intake ports, are formed upstream of the recessed portions 11 in the sheet conveyance direction. In the case where air is supplied from beyond the platen 5, the sheet 4 is likely to rise at its edge in the sheet conveyance direction. However, according to the third embodiment, in which air is taken in the recessed portions 11 from the upstream side, the sheet 4 can be inhibited from rising in a manner in which the conveyance rollers 60 hold the sheet 4 while interposing the sheet 4 therebetween because the conveyance rollers 60 are disposed upstream of the platen 5 in the sheet conveyance direction. Although the sheet-discharging rollers (not illustrated) are disposed downstream of the platen 5 in the sheet conveyance direction, the force by which the sheet 4 is held by the sheet-discharging rollers is weaker than by the conveyance rollers 60. Accordingly, in the case where one groove 24 is formed so as to correspond to each recessed portion 11, the groove 24 is preferably formed upstream of the recessed portion 11 in the sheet conveyance direction. According to the first modification to the third embodiment, as illustrated in FIG. 8B, the grooves 24 may be formed on both sides upstream and downstream of each recessed portion 11 in the sheet conveyance direction. According to the second modification, as illustrated in FIG. 8C, the wall 52 may be disposed beyond each recessed portion 11 in the sheet width direction.

Fourth Embodiment

Figure 9A:
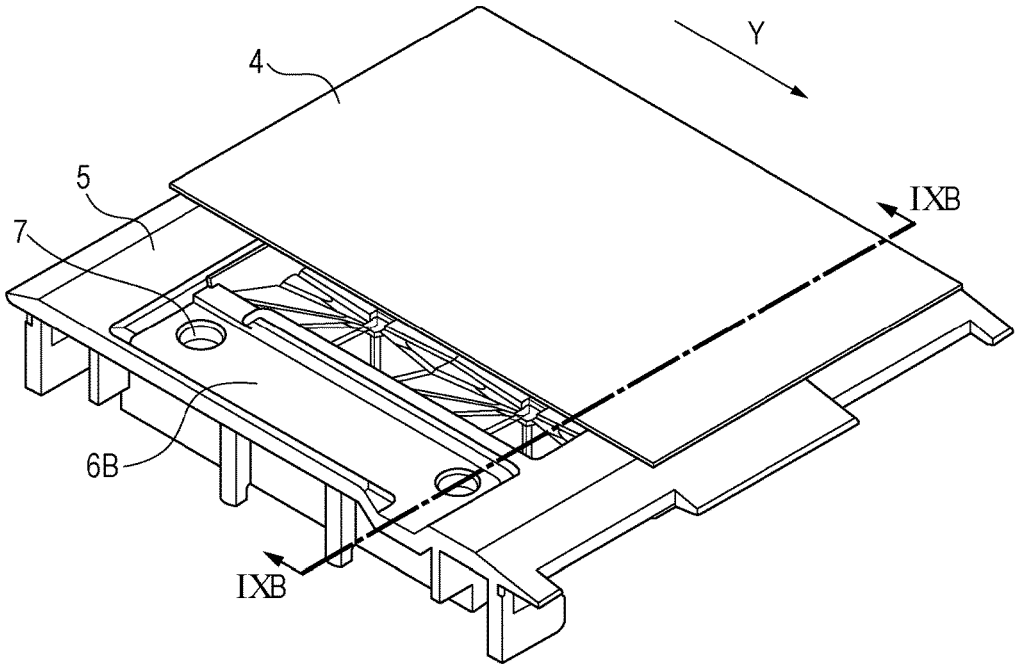
FIGS. 9A and 9B illustrate part of a platen according to a fourth embodiment.
Figure 9B:
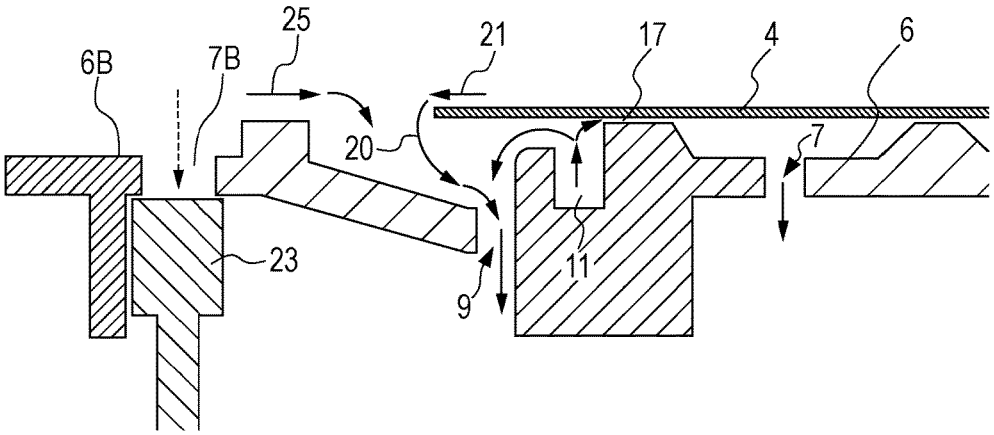

FIGS. 9A and 9B illustrate part of a platen 5 according to a fourth embodiment. FIG. 9A is a perspective view of part of the platen 5 supporting the sheet 4. FIG. 9B is a sectional view of part of the platen 5 taken along line IXB-IXB in FIG. 9A. According to the fourth embodiment, the sheet 4 does not pass through a non-contact portion 6B on the left side in the figures, and air suction by the first suction holes 7B of the non-contact portion 6B is stopped (see FIG. 9B). The basic structure of the apparatus is the same as in the first embodiment, and components having the same function are designated by like symbols.

A switching valve 23 (sealing unit) serving as a unit that stops the air suction by the corresponding first suction hole 7B is disposed below the first suction hole 7B in the vertical direction. The switching valve 23 switches a state of the first suction hole 7B between a communication state in which the first suction hole 7B opens and a non-communication state in which the first suction hole 7B closes. The switching valve 23 is disposed so as to correspond to each first suction hole 7B, and the state of each first suction hole 7B is individually controlled between the communication state and the non-communication state in accordance with the width of the sheet. The control is performed in a manner in which a signal of the size of the sheet that is specified by a user for the image printing apparatus 1 is received, and the corresponding switching valve 23 moves in the vertical direction. When the switching valve 23 moves upward in the vertical direction, the corresponding first suction hole 7B closes and is in the non-communication state. When the switching valve 23 moves downward in the vertical direction, the corresponding first suction hole 7B opens and is in the communication state. The switching valve 23 stops the air suction into the corresponding first suction hole 7B only. Air is sucked into the second suction holes 9 formed in the ink receiving portions 8.

FIG. 9B illustrates air flows when the switching valves 23 close the corresponding first suction holes 7B. As illustrated in FIG. 9B, when the air suction by the first suction holes 7B is stopped, air is supplied also from the side of the non-contact portion 6B to the second suction holes 9 (air flow 25). This inhibits air on the edge side of the sheet 4 from being supplied, as the air flow 21, toward the second suction holes 9 and inhibits ink applied to the edge of the sheet 4 from being out of place. Thus, the quality of an image at the edge of the sheet 4 can be improved. The smaller the size of the sheet 4, the smaller the area through which the sheet 4 passes. Accordingly, locations at which air is sucked reduce, and the power consumption of the negative-pressure generating member decreases.

That is, according to the present disclosure, an image printing apparatus that inhibits the back surface of a recording medium from being stained during marginless printing can be provided.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-064713 filed Mar. 28, 2016, which is hereby incorporated by reference herein in its entirety.

What is claimed is:

1. An image printing apparatus, comprising:

a printing head that ejects ink to perform printing;

a conveyance unit that conveys a recording medium in a first direction;

a platen that supports the recording medium at a position at which the platen faces the printing head;

a contact portion that is disposed on the platen and comes into contact with the recording medium;

a non-contact portion that is disposed on the platen so as to be surrounded by the contact portion and does not come into contact with the recording medium;

a first suction hole formed in the non-contact portion for causing the recording medium to adhere to the contact portion;

an ink receiving portion that is formed on the platen and receives ink ejected from the printing head to beyond the recording medium in a second direction intersecting the first direction during printing;

a second suction hole that is formed in the ink receiving portion and into which air is sucked near an edge of the recording medium in the second direction in an area through which the recording medium passes;

a recessed portion that extends in the first direction and is formed between the ink receiving portion and the contact portion in the second direction so as to be lower than the contact portion;

a supply portion that supplies air to a space defined by the recessed portion and the recording medium; and a communication portion for communicating the second suction hole and the recessed portion with each other at a position lower than the contact portion.

2. The image printing apparatus according to claim 1, wherein the recessed portion and the supply portion are in communication with each other such that the air supplied by the supply portion flows through the space defined by the recessed portion and the recording medium when the contact portion supports the recording medium.

3. The image printing apparatus according to claim 1, wherein the supply portion is disposed upstream of the recessed portion in the first direction.

4. The image printing apparatus according to claim 1, wherein the ink receiving portion, the recessed portion, and the supply portion are arranged so as to correspond to different sizes of the recording medium.

5. The image printing apparatus according to claim 1, wherein the ink receiving portion slopes so as to lower toward the center of the recording medium in the second direction.

6. The image printing apparatus according to claim 5, wherein the second suction hole is formed in the ink receiving portion so as to be near the center of the recording medium in the second direction.

7. The image printing apparatus according to claim 1, wherein the second suction hole comprises at least two second suction holes, one of which is formed on an upstream side in the first direction and the other of which is formed on a downstream side in the first direction.

8. The image printing apparatus according to claim 1, wherein an air-supplying unit that supplies air to the supply portion is disposed below the platen in the vertical direction, a switching unit is disposed between the supply portion and the air-supplying unit, and the switching unit switches between a connection state in which the supply portion and the air-supplying unit are connected to each other and a non-connection state in which the supply portion and the air-supplying unit are not connected to each other.

9. The image printing apparatus according to claim 8, wherein the supply portion that is not located near the edge of the recording medium in the second direction is switched by the switching unit so as to be in the non-connection state when the contact portion supports the recording medium.

10. The image printing apparatus according to claim 1, wherein the supply portion is disposed downstream of the recessed portion in the first direction.

11. The image printing apparatus according to claim 1, wherein the supply portion comprises a groove extending from the recessed portion to an upstream side in the first direction.

12. The image printing apparatus according to claim 1, wherein the supply portion comprises a groove extending from the recessed portion to an upstream side in the first direction and a groove extending from the recessed portion to a downstream side in the first direction.

13. The image printing apparatus according to claim 1, wherein the recessed portion includes a wall that is disposed beyond the supply portion in the second direction and that extends in the first direction.

14. The image printing apparatus according to claim 1, further comprising:

a sealing unit that switches a state of the first suction hole between a communication state in which the first suction hole opens and a non-communication state in which the first suction hole closes.

15. The image printing apparatus according to claim 14, wherein the state of the first suction hole located beyond the area through which the recording medium passes in the second direction is switched to the non-communication state by the sealing unit.

16. The image printing apparatus according to claim 1, further comprising:

a wall that extends in the first direction and is provided between the recessed portion and the second suction hole so as to be lower than the contact portion.

* * * * *